US006342834B1

(12) United States Patent
Berube et al.

(10) Patent No.: US 6,342,834 B1
(45) Date of Patent: Jan. 29, 2002

(54) PERSONAL SECURITY SYSTEM WITH ALARM LOCATION TRACKING

(75) Inventors: James Edward Berube, Victor; James Theodore Reed, Fairport, both of NY (US)

(73) Assignee: Detection Systems, Inc., Fairport, NY (US)

( * ) Notice: Subject to any disclaimer, the term of this patent is extended or adjusted under 35 U.S.C. 154(b) by 650 days.

(21) Appl. No.: 08/635,986

(22) Filed: Apr. 22, 1996

(51) Int. Cl.[7] ..... G08B 1/08

(52) U.S. Cl. ..... 340/539; 340/531; 340/533; 340/825.36; 340/825.49

(58) Field of Search ..... 340/539, 531, 340/533, 534, 573, 825.36, 825.44, 825.45, 825.49

(56) References Cited

U.S. PATENT DOCUMENTS 4,347,501 A * 8/1982 Akerberg ..... 340/539
4,611,198 A 9/1986 Levinson et al. ..... 340/539
4,630,035 A 12/1986 Stahl et al. ..... 340/539
4,694,282 A 9/1987 Tamura et al. ..... 340/539
4,764,757 A 8/1988 DeMarco et al. ..... 340/574
4,998,095 A 3/1991 Shields ..... 340/574
5,223,816 A 6/1993 Levinson et al. ..... 340/539
5,363,425 A * 11/1994 Mufti et al. ..... 379/38
5,365,217 A 11/1994 Toner ..... 340/539

* cited by examiner

*Primary Examiner*—Daryl Pope
(74) *Attorney, Agent, or Firm*—J. Addison Mathews

(57) ABSTRACT

A personal security system locates emergency transmissions and tracks changes in location between successive transmissions. The transmissions are repeated automatically over a predetermined time interval exceeding five minutes. A plurality of fixed receivers are provided in predetermined positions in a protected region for detecting the emergency transmissions and a central monitoring station locates the transmissions from information provided by the detecting receivers. The monitoring station tracks successive transmissions and displays multiple locations as icons on a monitor. The icons vary in size based on relative transmission time and are stacked so any overlapping icons representing more recent transmissions are on top.

12 Claims, 7 Drawing Sheets

PERSONAL SECURITY SYSTEM WITH ALARM LOCATION TRACKING

DESCRIPTION

Field of Invention

The invention relates to a personal security system for locating emergency transmissions. More specifically the invention pertains to such systems including a portable communicator actuated in an emergency to send wireless signals that are used by a monitoring station to locate and display the location of the sending communicator.

BACKGROUND OF THE INVENTION

Recently developed personal security systems locate subscribers in an emergency. The systems are installed in a protected region, such as a college or hospital campus, shopping center or building complex, and display the location of the emergency on a monitor at a central station.

A typical system is based on a portable transmitter carried by a subscriber and actuated in an emergency to send radio frequency signals identifying the transmitter to the system. Fixed receivers are installed at predetermined locations throughout the protected region. The receivers detect emergency transmissions and relay the transmitted information to the central monitoring station. The monitoring station identifies the subscriber to which the transmitter is assigned, locates the emergency based on the receivers that detect the transmission and displays the location to call appropriate security personnel. Examples of these and similar systems are disclosed in Shields U.S. Pat. No. 4,998,095, issued Mar. 5, 1991; DeMarco U.S. Pat. No. 4,764,757, issued Aug. 16, 1988; Levinson U.S. Pat. No. 4,611,198, issued Sep. 9, 1986 and Toner U.S. Pat. No. 5,365,217, issued Nov. 15, 1994.

Improved approaches for locating an emergency transmission are disclosed in Kostusiak et al. U.S. Pat. No. 5,115,224, issued May 19, 1992, and Malvaso et al. U.S. Pat. No. 5,416,466, issued May 16, 1995. In addition to the known positions of the detecting receivers, Kostusiak and Malvaso use relative signal strength between several receivers to more accurately locate the emergency transmission.

While existing approaches provide many advantages in personal security systems, they generally identify or display only a single location for each emergency. If a subscriber flees from an attacker, or is forced under duress to accompany the attacker, the system does not track the movement or display the path or direction of travel.

SUMMARY OF THE INVENTION

The present invention is directed to improvements in personal security systems and overcoming one or more of the problems set forth above. Briefly summarized, according to one aspect of the invention, a portable communicator, for use with a personal security system, includes a transmitter for sending wireless signals identifying the communicator to the system. A manually operated actuator initiates the transmission, which is then repeated automatically over a predetermined time interval exceeding five minutes. The transmissions are discontinued at the end of the predetermined time interval or by operating the communicator in a second non-emergency mode such as a test. According to more specific features, the transmissions repeat at least once a minute for a predetermined time interval exceeding ten minutes. Still more specifically, the identifying signals are transmitted as a multi-packet signal stream repeated approximately once every thirty seconds for an interval of approximately fifteen minutes. The transmitter is dormant between transmissions.

According to other aspects of the invention, the identifying signals include a tracking bit that is set to a first state for the manually initiated transmission and a second state different from the first state for the automatic transmissions. The tracking bit permits differentiation at a monitoring station between the manually initiated and automatic transmissions.

Other aspects of the invention include a plurality of fixed receivers at predetermined locations in a protected region for detecting the emergency transmissions and a central monitoring station that locates the transmissions based on the fixed receivers detecting the transmissions. The monitoring station tracks and simultaneously displays multiple locations of successive transmissions. More specifically, the monitoring station compares the locations of first and second successive transmissions, a) displays both locations when they are spaced more than a predetermined distance, and b) displays only the first of the two locations when they are spaced less than the predetermined distance. The monitor represents the multiple locations as icons that vary in size based on relative transmission time and are stacked so that any overlapping icons representing more recent transmissions are on top.

These and other features and advantages of the invention will be more clearly understood and appreciated from a review of the following detailed description of the preferred embodiments and appended claims, and by reference to the accompanying drawings.

DETAILED DESCRIPTION OF THE INVENTION

Figure 1:
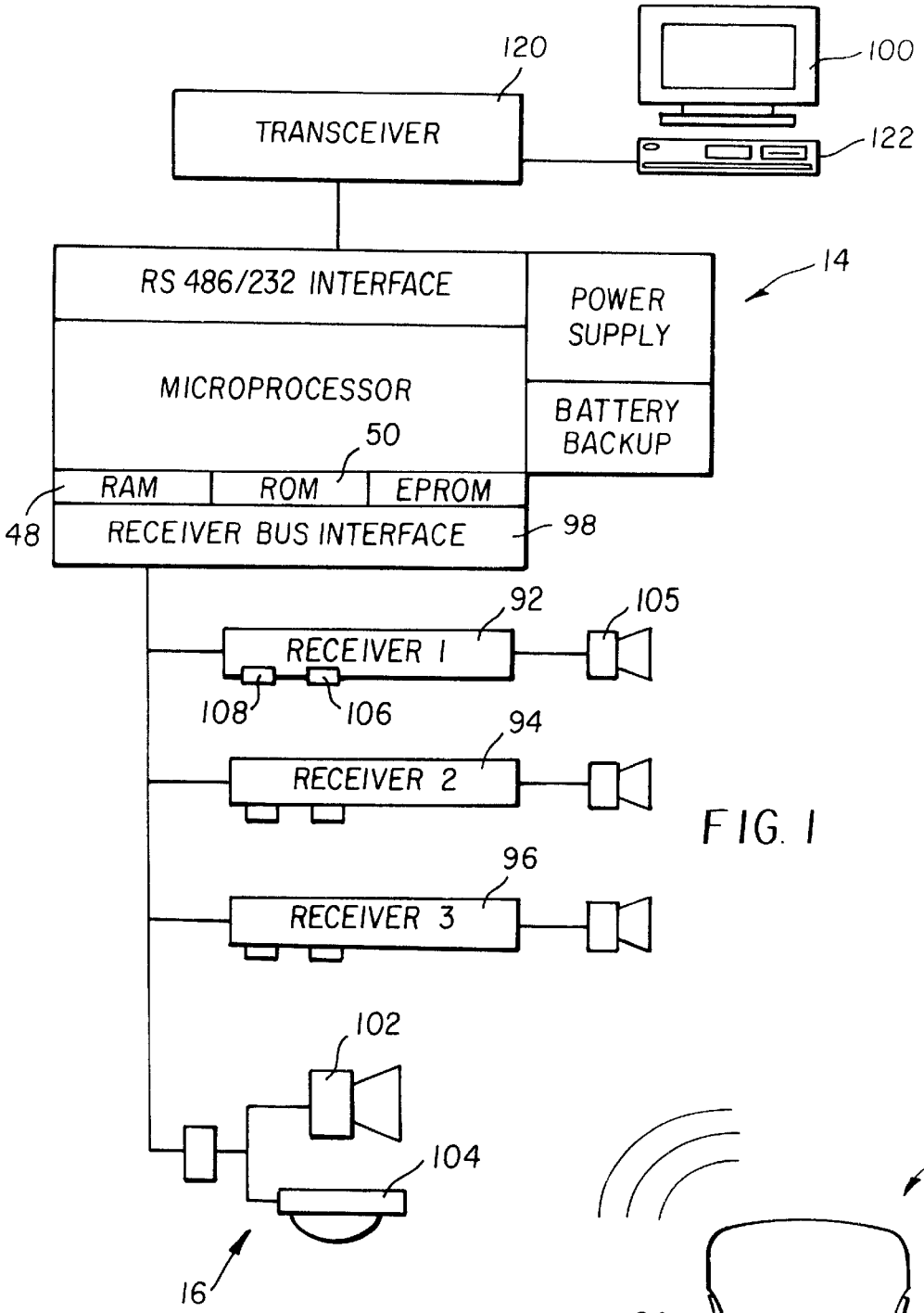
FIGS. 1 and 2 are schematic views of a personal security system in accordance with a preferred embodiment of the invention including fixed receivers, local control centers and a monitoring station in FIG. 1 and a portable communicator in FIG. 2.
Figure 2:
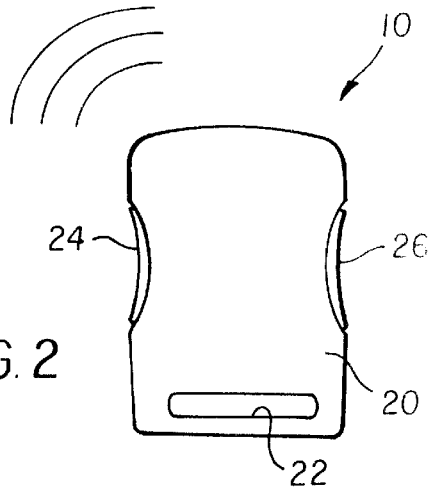

Referring now to FIGS. 1 and 2, a preferred embodiment of the invention is depicted in a personal security system including hand-portable communicators 10, fixed receivers 12, local control centers 14, alarms 16 and a central monitoring station 18.

The communicators 10 are carried by subscribers to the system for actuation in emergency or threatening situations to initiate planned events that scare away attackers and call for assistance. When actuated, the communicator transmits wireless signals to the surrounding area, at a predetermined frequency and signal strength, including a code that identifies the communicator to the system.

Receivers 12 monitor the protected region for transmissions and, in combination with local control centers 14 and central monitoring station 18, initiate the planned events. The receivers detect and decode information from each transmission, including the identification of the transmitting communicator and the strength of the received signal. The identification and strength information is stored in the receiver for retrieval by the local control centers 14, which repeat or forward the retrieved information to monitoring station 18. The monitoring station uses the forwarded information to determine the location of the transmitting communicator and the name of the subscriber to which the communicator is assigned. Alarms 16 are actuated in the vicinity of the determined location, and security personnel are dispatched to that location for assistance.

Once actuated to transmit an emergency signal, the communicator 10 repeats the transmissions, preferably once every thirty seconds, for a predetermined time interval, preferably fifteen minutes. The central monitoring station 18 uses the signal repetitions to track and display any movement of the transmitter associated, for example, with fleet from an attacker.

Communicators and Transmitted Signal

Figure 3:
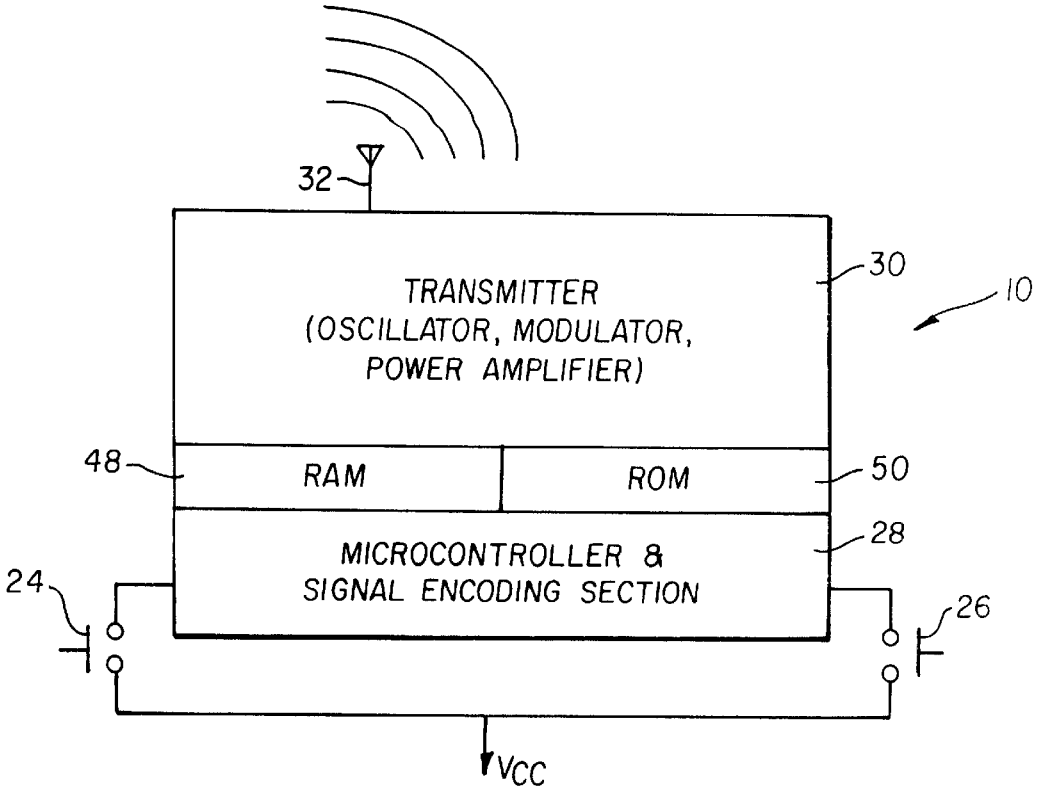
FIG. 3 is a schematic diagram of the portable communicator of the preferred embodiment.

The hand-portable communicator 10, most clearly shown in FIGS. 2 and 3, is battery powered and adapted for convenient carrying in a purse or pocket. It is enclosed in a plastic case 20 including a key ring 22 and two switches depicted as depressable buttons 24 and 26. The switches are designed for actuation from opposite sides of the case 20 against a spring bias and in sequences that normally prevent accidental operation.

The switches 24 and 26 initiate operation of the communicator, either in an alarm state or a test state, depending on the sequence of actuation. In both cases, alarm and test, the communicator produces and transmits a radio frequency signal to the local geographic area at a predetermined frequency and signal strength. The frequency may be in the three hundred or nine hundred megahertz range typical for such applications. The signal strength is chosen in combination with the number and locations of fixed receivers 12 so more than one and preferably at least three receivers typically will be able to detect the transmitted signal for the purposes to be described. At the same time, the signal strength, which falls off with the inverse square of the distance, should be weak enough to facilitate the location of the transmission based on differences in the signal strength at the detecting receivers.

Figure 4:
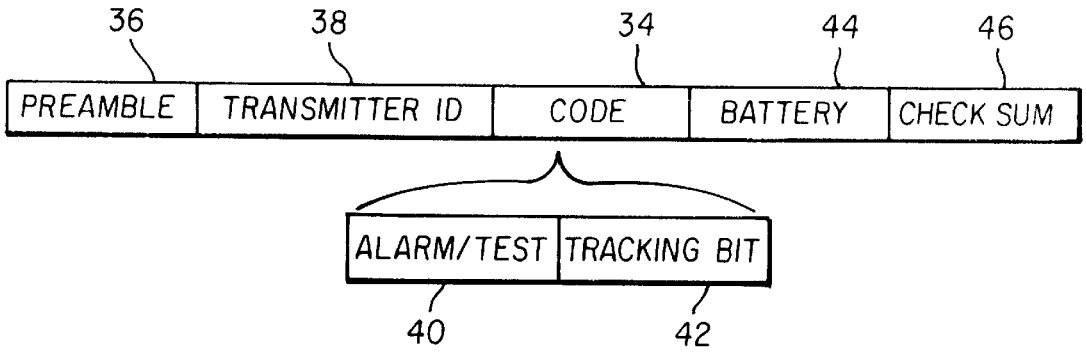
FIG. 4 is a schematic diagram of a signal packet transmitted by the communicator according to the preferred embodiment.

Actuation of the switches 24 and 26, in either an alarm or a test mode, causes a microcontroller 28 (FIG. 3) to initiate operation of a transmitter 30, sending the radio frequency signals through antenna 32 to the local geographic area. The transmitted signal, sometimes referred to as a signal stream, includes a series of eight identical packets of information 34 (FIG. 4) having an irregular spacing in the stream to reduce the risk of jamming with other possible transmissions. The packets take approximately sixteen milliseconds to transmit, with approximately one hundred milliseconds between packets. A signal stream of eight packets takes approximately one second to transmit. Each packet contains the information identified on FIG. 4, including a preamble 36, a user or transmitter identification (ID) code 38, an alarm or test code 40, a tracking bit 42, a low-battery warning bit 44, and a check sum 46 for error detection. Appropriate memory 48 and 50 (FIG. 3) are included in the communicator to support the microcontroller in carrying out its various functions.

The transmitter ID code 38 is programmed and stored in memory 48 or 50, either at the time of manufacture or when the user subscribes to the system. The alarm or test code 40 is determined by the manner in which switches 24 and 26 are actuated. Simultaneous actuation of the switches 24 and 26 sets the code to indicate an alarm. Sequential actuation, first one switch and then the other, sets the code to indicate a test. The tracking bit 42 is set by the microcontroller 28. For reasons that will become more apparent from the following description, on the first or manually initiated transmission of an alarm, the tracking bit 42 is cleared to indicate the first transmission. During subsequent automatic transmissions, however, the tracking bit is set.

Figure 5:
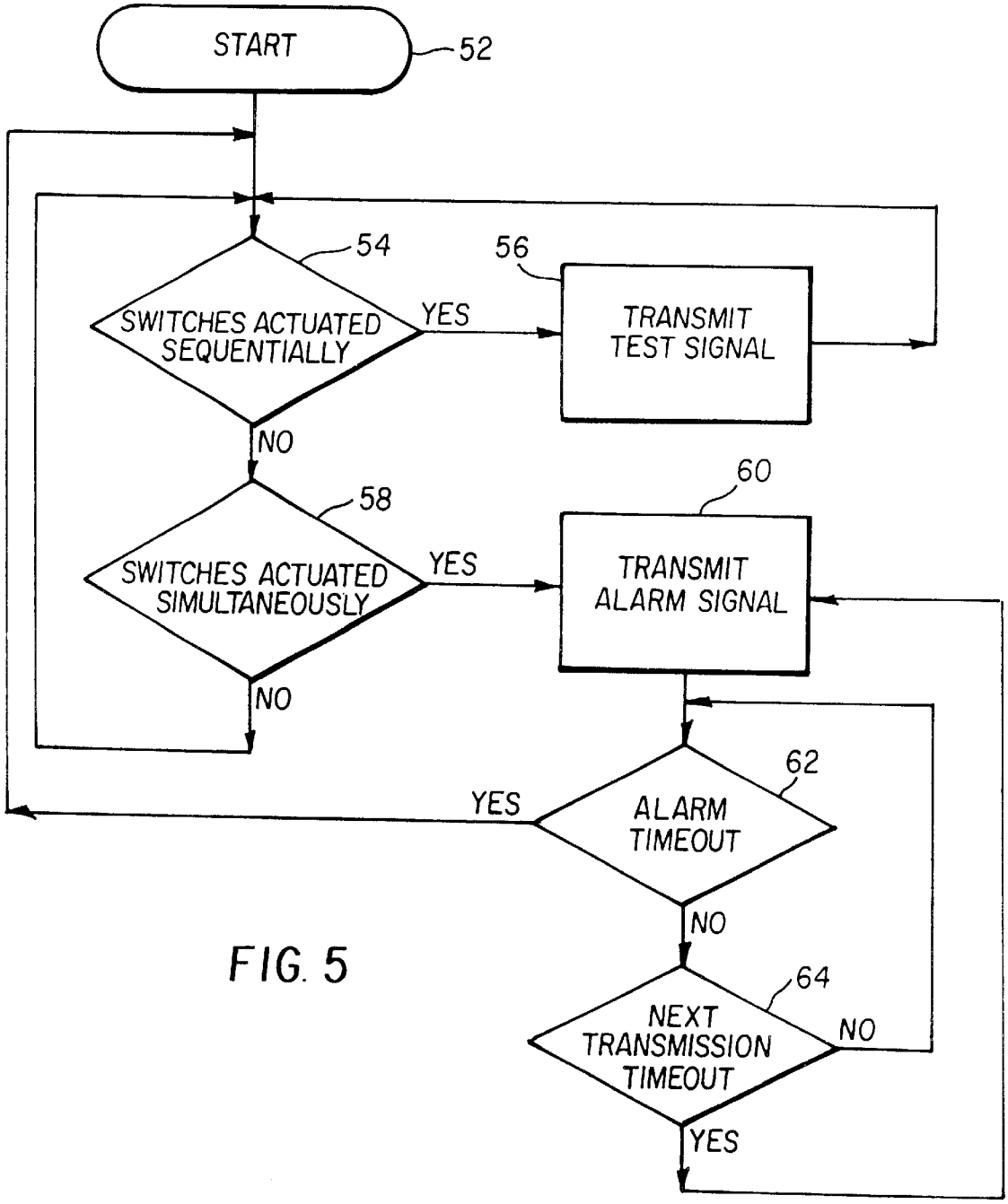
FIG. 5 is a flow diagram summarizing the operation of the preferred communicator.

FIG. 5 summarizes the operation of the portable communicator, which will be described in combination with FIGS. 1–4. Beginning at 52, the switches 24 and 26 are actuated sequentially to initiate a test, boxes 54 and 56, or simultaneously to initiate an alarm, boxes 58 and 60. Microcontroller 28 operates transmitter 30 to send the signal packet 34 with the alarm/test code 40 set to appropriately indicate a test or an alarm in accordance with the mode of switch operation. For a test, the signal stream of eight packets is transmitted only once. For an alarm, on the other hand, the signal stream is transmitted repeatedly, such as more frequently than once a minute, for a predetermined time interval of at least five minutes, and preferably at least ten minutes. In this preferred embodiment the transmissions are repeated approximately every thirty seconds for approximately fifteen minutes. The alarm signal repetitions are depicted at 60, 62 and 64.

Figure 6:
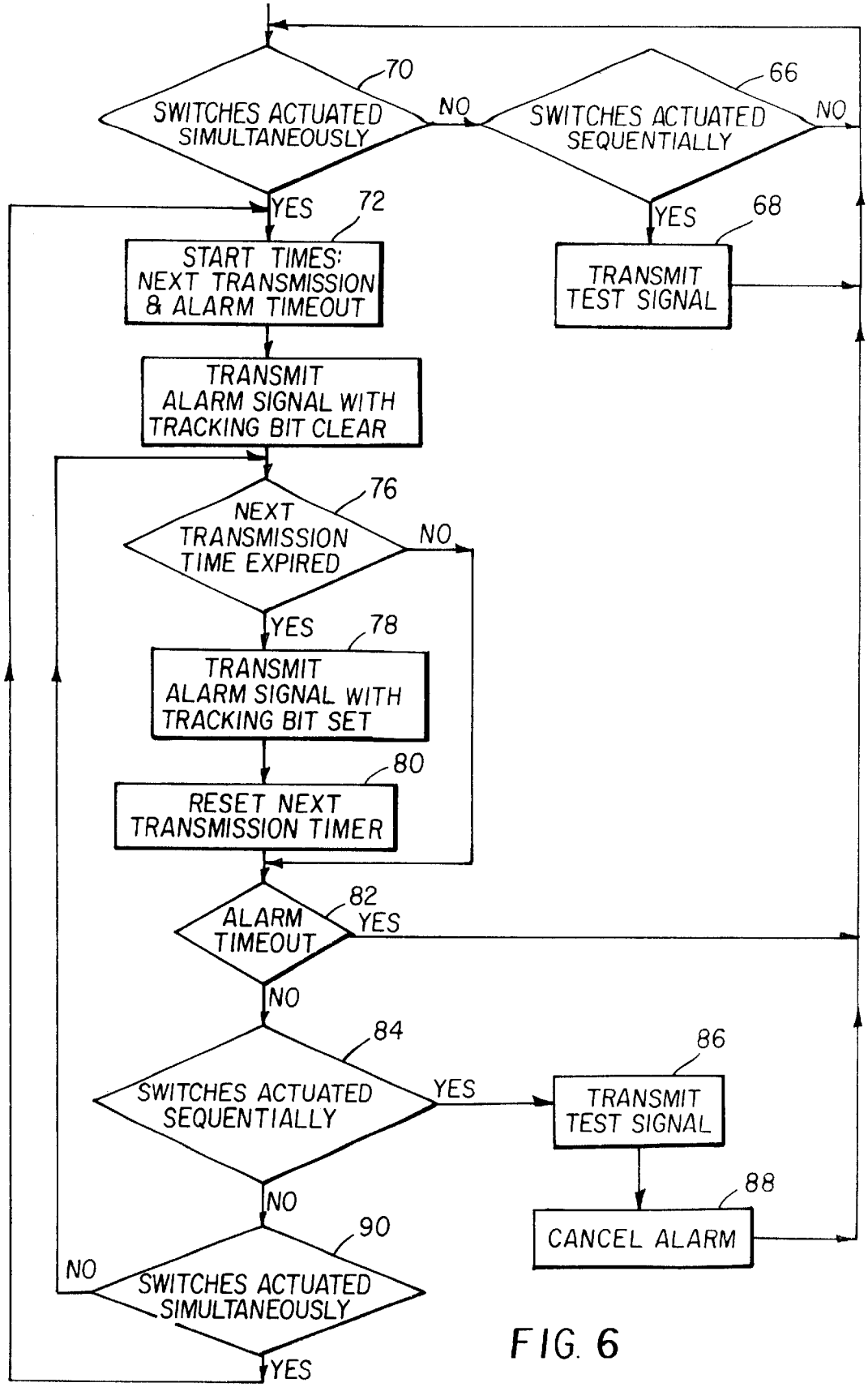
FIG. 6 is a flow diagram depicting further details of the communicator operation according to the preferred embodiment.

The same operation is represented in more detail in FIG. 6, again with reference to FIGS. 1–4. Sequential actuation of switches 24 and 26 (FIGS. 2 & 3) initiates a single transmission of the test signal, boxes 66 and 68. Simultaneous operation, on the other hand, initiates repeated transmissions of the alarm signal, boxes 70, 72, 74, 76, 78, 80, and 82. Timers are set at 72: 1) one for the next transmission or repetition interval, and 2) another for the overall alarm timeout. At 74, the tracking bit is cleared and the first transmission occurs. At 76, the repetition interval times out, and at 78 and 80 the signal transmission is repeated with the tracking bit set. This cycle repeats until the overall alarm times out, box 82, and the transmissions automatically are discontinued.

The repeated alarm transmissions can be discontinued manually at any time by initiating a test transmission, boxes 84 and 86, which cancels the alarm, box 88.

If another manual alarm is initiated by simultaneous actuation of switches 24 and 26 during the automatic cycle, the manual alarm overrides and restarts the automatic sequence as indicated at 90.

Receivers, Alarms and Local Control Centers

The receivers 12 (FIG. 1) include a plurality of receivers, exemplified by 92, 94 and 96, spaced at predetermined locations throughout the protected area. Each respective receiver is tuned to continuously monitor the predetermined frequency used by the portable transmitters. They decode transmitter signals, validate the transmission for proper format, sample the strength of validated signals and set a normal/off-normal bit flag depending on the information received. A decoded transmission, assuming it is in the proper format, is stored in a data register, including the received signal strength, the identification number of the portable transmitter and the state of the normal/off-normal flag bit.

The receivers communicate with their associated local control center 14 through a multiplex bus interface 98. The local control center 14 queries each respective receiver using a unique receiver address code. If the flag bit is normal, the control center 14 continues with queries cycled to other receivers. If the flag bit is off-normal, indicating, for example, either an alarm or a test, the local control center 14 requests the stored information. This includes the reason for the off-normal condition, e.g. alarm or test, the strength of the received signal and the identification code of the sending transmitter. The local control center 14 also links the retrieved transmitter and signal information with an identification code associated with the receiver that is holding the information.

Several receivers, such as 92, 94 and 96, preferably will receive, store and transfer information connected with a single alarm or test. The local control center 14 sends the information, including received signal strength, transmitter identification, and receiver identification, on to the central monitoring station 18. The central monitoring station uses the information, and any other information that might be received from other local control centers, to display on a monitor 100 icons representing the location of the detecting receivers. The central monitoring station also uses the information to calculate and display an icon representing the predicted location of the transmitting communicator.

If the off-normal condition is caused by an alarm, the local control center 14 and central monitoring station 18 will issue commands activating a sounder 102 and strobe 104 closest to the above-mentioned receivers. A horn 105 associated with each detecting receiver also is energized. If the off-normal condition is caused by a test, the central monitoring station 18 will use the unique identification of the portable transmitter to look in its records for an active subscriber, and will indicate the results of the test by energizing a green or red light emitting diode (LED) 106 or 108, respectively, on the detecting receivers. The red LED might be actuated, for example, to indicate an expired subscription, while the green LED would indicate a successful subscriber test.

Figure 7:
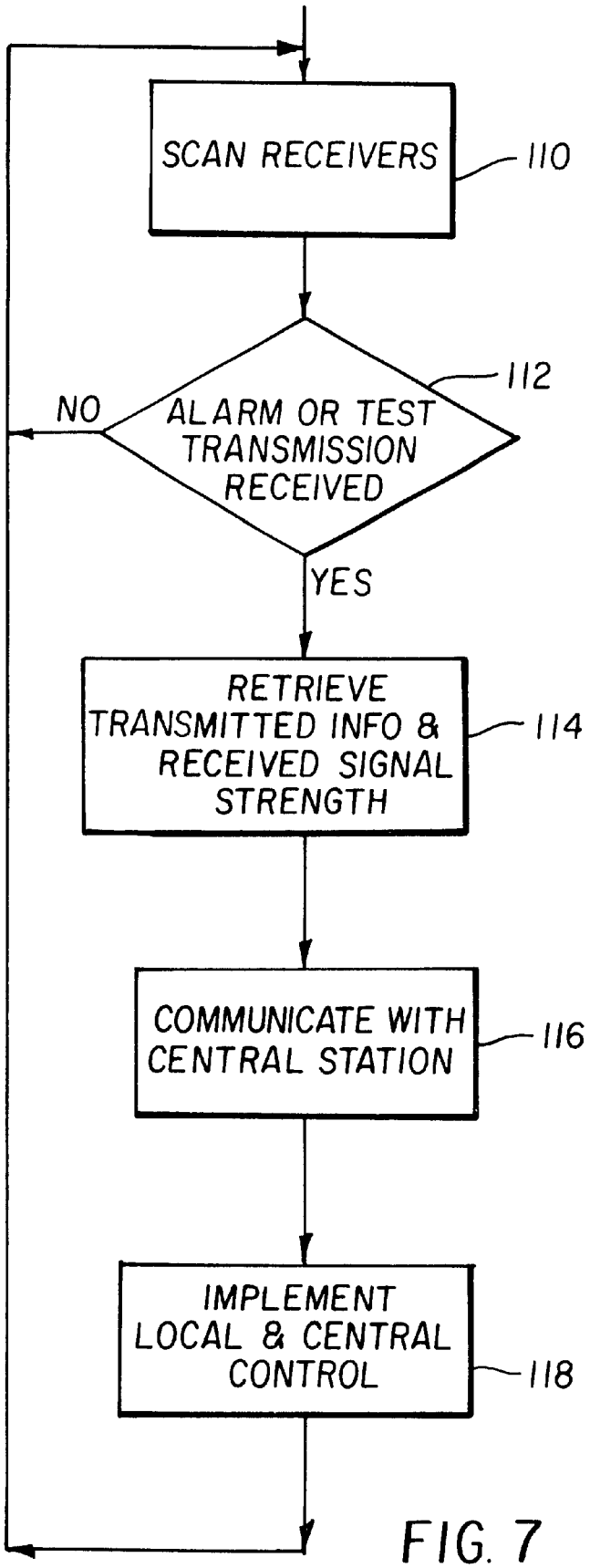
FIG. 7 is a flow diagram depicting the operation of the fixed receivers and relays according to the preferred embodiment.

The operation of the local control center is summarized as a flow diagram on FIG. 7. The receivers are scanned at 110. If the off-normal flag indicates that an alarm or test transmission was detected, 112, the information stored in the detecting receiver(s) is retrieved at 114, and the information in the strongest signals is forwarded to the central monitoring station at 116. The forwarded information includes the identification of the transmitting communicator, the identification of the detecting receiver and the received signal strength at the detecting receiver. The local control center then receives acknowledgments from the central monitoring station 18 and implements commands from the station at 118.

Central Monitoring Station

Central monitoring station 18 (FIG. 1) includes a transceiver 120 and computer 122 with monitor 100. The central monitoring station communicates with the local control centers 14 for controlling the sounders and strobes 102 and 104 in the alarm mode and the red and green LEDs 106 and 108 in the test mode. The central monitoring station also is used for entering system information and parameters. It might include a map of the protected area and a program for showing the locations of receivers in the vicinity of an alarm or test transmission. Typically, the central monitoring station will store subscriber records including active or inactive status, identification of the portable communicator assigned to each subscriber, and the times and locations from which it was used, either in an emergency or for a test.

Figure 8:
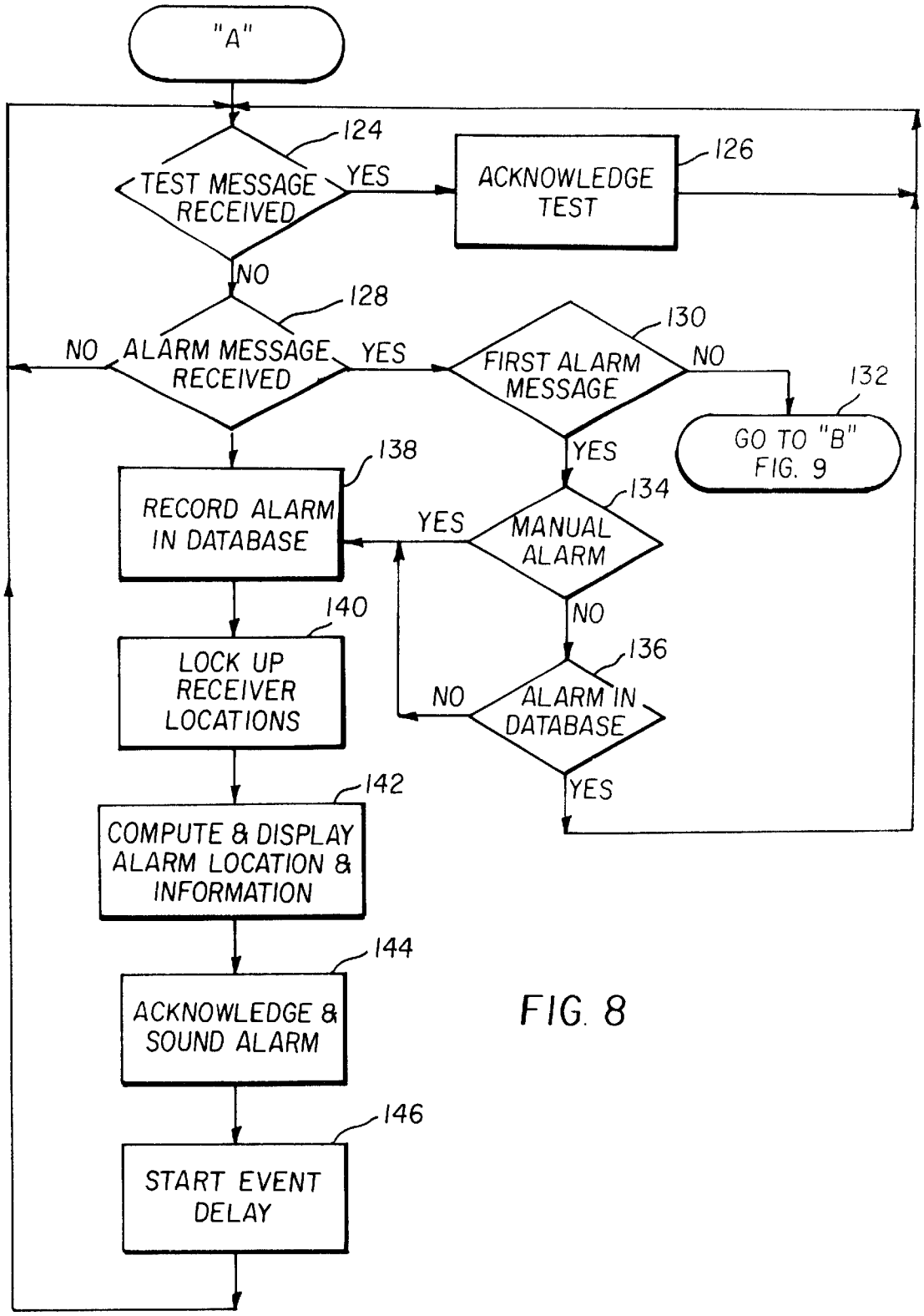
FIGS. 8 and 9 are flow diagrams depicting the operation of the monitoring station according to the preferred embodiment
Figure 9:
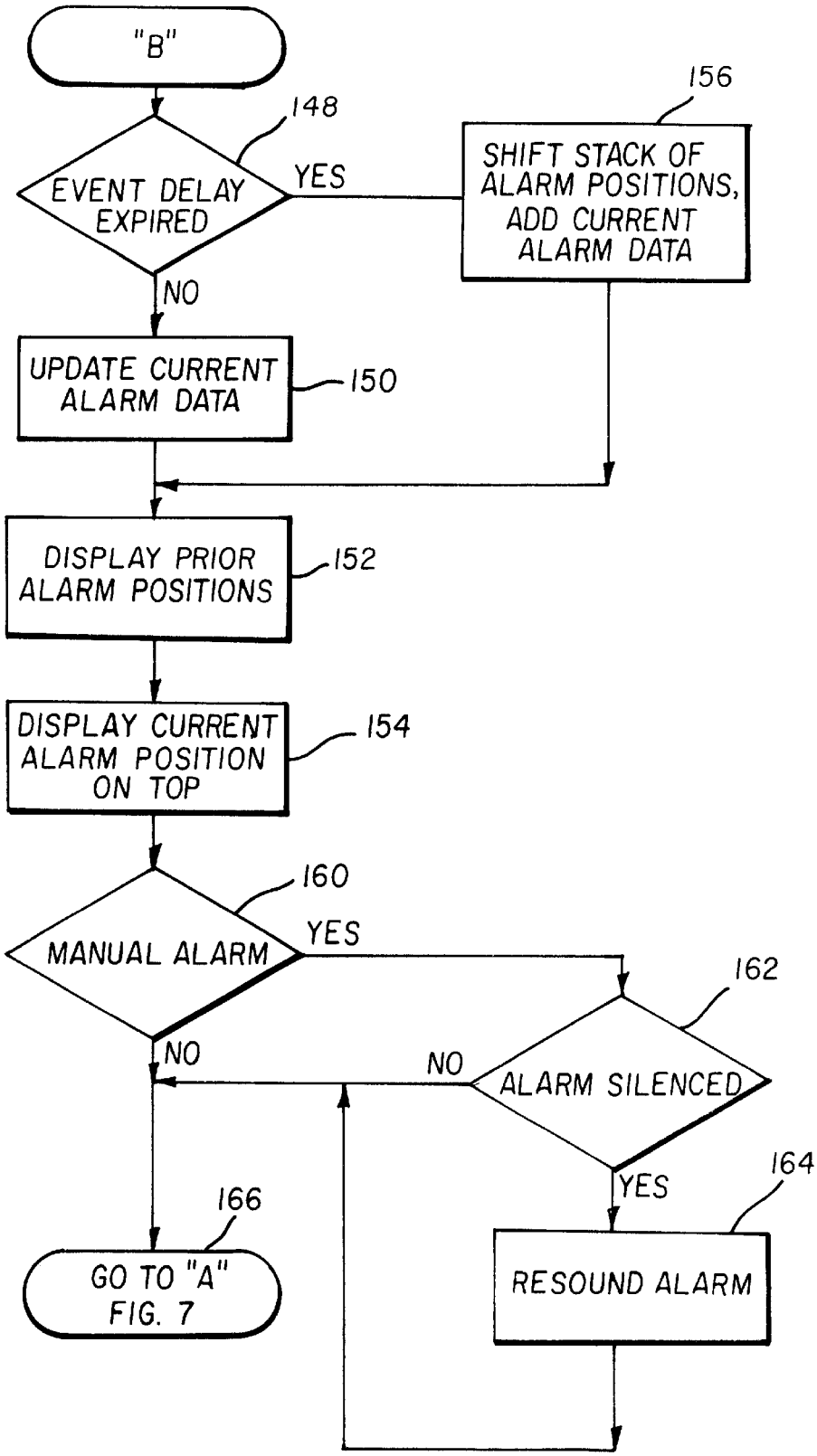

The central monitoring station also locates and tracks any movement of a transmitting communicator as depicted by the flow diagram of FIGS. 8 and 9.

Beginning with FIG. 8, the central monitoring station acknowledges tests and issues commands to energize the appropriate LED 106 or 108, boxes 124 and 126. When an alarm is received, box 128, the station looks in memory to determine if the alarm is the first alarm received for this event, box 130. If it is not the first alarm, the flow diagram proceeds as depicted in FIG. 9, described hereinafter, box 132. If it is the first alarm, the monitoring station uses the tracking bit to determine if the alarm is a manual alarm, box 134, or an automatic alarm, box 136. A manually initiated alarm is identified by a cleared tracking bit 42 (FIG. 4), while an automatic transmission is identified by a set tracking bit.

A manual alarm is recorded in memory at 138 and the transmitted information is used to compute and display the location of the transmitting communicator, boxes 140 and 142. The alarm is sounded, box 144, and an event timer is started, box 146. The event timer times out in ten seconds, and is used to determine if the detected transmissions are from a single communicator transmission or multiple communicator transmissions. A single transmission might be detected at several receivers, and this is the assumption made by the central monitoring station whenever they are received and reported within the ten seconds event timeout.

Even though an alarm is recognized and cleared centrally, the communicator will continue to transmit for fifteen minutes or until a test transmission is initiated. In this case, the central monitoring station may receive a first alarm that is not a manual alarm but corresponds to an alarm recorded in memory within the past fifteen minutes. As represented by box 136, the monitoring station assumes that appropriate action has been taken and no further alarm is required.

Referring now to FIG. 9, if the ten second event delay has not expired, box 148, the alarm information is assumed to be from a single transmission. The alarm information is then used with other data from the same transmission to determine and display the location of the transmitting communicator, boxes 150, 152 and 154. The monitoring station also determines if the transmitting communicator has moved and compares the most recently determined location to any prior location. If the transmitting communicator moved a distance greater than a predetermined amount, preferably thirty feet, or half the diameter of its corresponding monitor icon, the most recent location and the prior two locations are simultaneously displayed on the monitor. If the location has not changed by the predetermined amount, no change in location is displayed.

The prior locations are displayed first, and are represented by smaller icons. The icon representing the oldest location is displayed first, followed by the icon representing the next most recent location, which is in front of and twice the diameter of the first icon, followed by the icon representing the most recent location, which is in front of and twice the size of the previously displayed icon. All three locations are displayed simultaneously to show the direction and path of travel. The respective locations also may be displayed in different colors compared to other locations.

If the ten second event delay has expired, box 148, the central monitoring station assumes that the alarm is from another transmission, probably an automatic transmission. The transmitted information is used to determine a new alarm position, and the stack of alarm positions is shifted with the most recent position being added to the stack, box 156.

A new manual alarm, box 160, restarts the alarm if it has been silenced, boxes 162 and 164, and restarts the alarm sequence, box 166.

It should now be apparent that the invention provides an improved personal security system that locates emergency transmissions and indicates the direction or path of any movement after the first transmission. Multiple successive locations are displayed simultaneously on a monitor. The monitor presents the multiple locations as icons that vary in size based on relative transmission time and are stacked so that any overlapping icons representing more recent transmissions are on top.

While the invention is described in connection with a preferred embodiment, other modifications and applications will occur to those skilled in the art. The claims should be interpreted to fairly cover all such modifications and applications within the true spirit and scope of the invention.

PARTS LIST

Reference No. Part
10. Communicator.
12. Receivers.
14. Local control center.
16. Alarms.
18. Central monitoring station.
20. Case.
22. Key ring.
24. Button.
26. Button.
28. Microcontroller.
30. transmitter.
32. Antenna.
34. Information packet.
36. Signal preamble.
38. Identification code.
40. Alarm or test code.
42. Tracking bit.
44. Low-battery warning bit.
46. Check sum.
48. Memory.
50. Memory.
52–90 (even numbers). Flow diagram.
92. Receiver.
94. Receiver.
96. Receiver.
98. Bus Interface.
100. Screen.
102. Sounder.
104. Strobe.
105. Horn.
106. LED.
108. LED.
110–118 (even numbers) Flow diagram.
120. Transceiver.
122. Computer.
124–166 (even numbers) Flow diagrams.

What is claimed is:

1. A portable communicator for use with a personal security system; said communicator comprising:

a transmitter for transmitting wireless signals identifying said communicator to said system;

a manually operated actuator initiating said transmission of said identifying signals; and, a control responsive to said manual initiation and automatically transmitting said identifying signals repeatedly over a predetermined time interval exceeding five minutes, said control automatically discontinuing said automatic transmissions at the end of said predetermined time interval;

wherein said identifying signals are transmitted as a multi-packet signal stream repeated approximately every thirty seconds for an interval of approximately fifteen minutes, said transmitter being dormant between said transmissions of said signal streams.

2. A portable communicator for use with a personal security system; said communicator comprising:

a transmitter for transmitting wireless signals identifying said communicator to said system;

a manually operated actuator initiating said transmission of said identifying signals; and, a control responsive to said manual initiation and automatically transmitting said identifying signals repeatedly over a predetermined time interval exceeding five minutes, said control automatically discontinuing said automatic transmissions at the end of said predetermined time interval;

wherein said identifying signals include a tracking bit that is set to a first state for said manually initiated transmission and a second state different from said first state for said automatic transmissions.

3. A portable communicator for use with a personal security system; said communicator comprising:

a transmitter for transmitting wireless signals identifying said communicator to said system;

a manually operated actuator initiating said transmission of said identifying signals; and, a control responsive to said manual initiation and automatically transmitting said identifying signals repeatedly over a predetermined time interval exceeding five minutes, said control automatically discontinuing said automatic transmissions at the end of said predetermined time interval;

wherein said manually operated actuator has a first mode of operation initiating an emergency transmission and a second mode of operation not initiating an emergency transmission, and wherein said control responds to operation of said actuator a) in said first mode to initiate said automatic transmissions and b) in said second mode to discontinue said automatic transmissions.

4. The invention of claim 3, wherein said manually operated actuator in said second mode of operation initiates a test transmission.

5. A personal security system for locating emergency transmissions in a protected region, said system comprising:

a portable communicator including a radio frequency transmitter and a manual actuator operating said transmitter to initiate multiple time-spaced transmissions of an emergency signal;

a plurality of fixed receivers in predetermined positions in said protected region for detecting said transmissions; and, a central monitoring station for locating said transmissions based on the fixed receivers detecting said transmissions, said monitoring station including means for tracking and simultaneously displaying multiple locations of said time-spaced transmissions.

6. The invention of claim 5, wherein said monitoring station compares the locations of first and second successive transmissions, and wherein said tracking and displaying means a) displays both of said first and second locations when said first and second locations are spaced more than a predetermined distance and b) displays only one of said first and second locations when said first and second locations are spaced less than said predetermined distance.

7. The invention of claim 5, wherein said tracking and displaying means represents said multiple locations as icons and wherein said icons vary in size based on relative transmission time.

8. The invention of claim 7, wherein said icons are stacked with said icons representing more recent transmissions on top.

9. A personal security system for locating emergency transmissions in a protected region, said system comprising:

a transmitter for transmitting radio frequency signals identifying said communicator to said system;

a manually operated actuator initiating said transmission of said identifying signals;

a control responsive to said manual initiation and automatically transmitting said identifying signals repeatedly over a predetermined time interval exceeding five minutes, said control automatically discontinuing said automatic transmissions at the end of said predetermined time interval;

a plurality of fixed receivers in predetermined positions in said protected region for detecting said transmissions; and, a central monitoring station for locating said manually initiated and automatic transmissions based on the fixed receivers detecting said transmissions, said monitoring station including means for tracking and simultaneously displaying multiple locations of said time-spaced transmissions.

10. The invention of claim 9, wherein said monitoring station compares the locations of first and second successive transmissions, and wherein said tracking and displaying means a) displays both of said first and second locations when said first and second locations are spaced more than a predetermined distance and b) displays only one of said first and second locations when said first and second locations are spaced less than said predetermined distance.

11. The invention of claim 9, wherein said tracking and displaying means represents said multiple locations as icons and wherein said icons vary in size based on relative transmission time.

12. The invention of claim 11, wherein said icons are stacked with said icons representing more recent transmissions on top.

* * * * *